US006491381B2

(12) United States Patent
Mochizuki et al.

(10) Patent No.: US 6,491,381 B2
(45) **Date of Patent: *Dec. 10, 2002**

(54) LIQUID DISCHARGE HEAD AND LIQUID DISCHARGE APPARATUS

(75) Inventors: Muga Mochizuki, Yokohama (JP); Ichiro Saito, Yokohama (JP); Toshio Kashino, Chigasaki (JP); Yoshiyuki Imanaka, Kawasaki (JP); Teruo Ozaki, Yokohama (JP); Masahiko Kubota, Tokyo (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/452,207

(22) Filed: Dec. 1, 1999

(65) Prior Publication Data

US 2002/0140773 A1 Oct. 3, 2002

(30) Foreign Application Priority Data

Dec. 3, 1998 (JP) ..... 10-344722

(51) Int. Cl.[7] ..... B41J 2/05
(52) U.S. Cl. ..... 347/65
(58) Field of Search ..... 347/65, 63, 56, 347/54, 67

(56) References Cited

U.S. PATENT DOCUMENTS

| | | | | |
|---|---|---|---|---|
| 4,723,129 A | | 2/1988 | Endo et al. | |
| 5,278,585 A | | 1/1994 | Karz et al. | |
| 5,821,962 A | * | 10/1998 | Kudo et al. | 347/65 |

FOREIGN PATENT DOCUMENTS

| | | | | |
|---|---|---|---|---|
| EP | 0745479 A2 | | 12/1996 | B41J/2/14 |
| EP | 0819538 A | | 1/1998 | B41J/2/05 |
| EP | 0819538 A2 | * | 1/1998 | B41J/2/14 |
| EP | 0895861 A1 | | 2/1999 | B41J/2/05 |
| EP | 0982136 A2 | | 3/2000 | B41J/2/14 |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

In a liquid discharge head having an element substrate on the surface of which are provided in parallel a plurality of discharge energy generating elements generating heat energy for creating a bubble in liquid, a fixed portion provided on the element substrate so as to face the plurality of discharge energy generating elements, and fixed to the element substrate, and a plurality of movable members comprising a movable portion extending from the end portion of the fixed portion and displaced by the bubble, a fulcrum about which the movable portion is displaced is located on the movable portion other than a corner portion formed at the boundary between the movable portion and the fixed portion.

9 Claims, 9 Drawing Sheets

LIQUID DISCHARGE HEAD AND LIQUID DISCHARGE APPARATUS

BACKGROUND OF THE INVENTION

1. Field of the Invention

This invention can be applied to apparatuses such as a printer, a copying machine, a facsimile apparatus such as a communication system and a word processor having a printer portion for effecting recording on a recording medium such as paper, yarn, fiber, cloth, metals, plastics, glass, wood or ceramics, and further an industrial recording apparatus compositely combined with various processing apparatuses.

The term "recording" in the present invention means not only imparting meaningful images such as characters and figures to a recording medium, but also imparting meaningless images such as patterns to a recording medium.

2. Related Background Art

There is known an ink jet recording method, i.e., a so-called bubble jet recording method, of imparting energy such as heat to ink to thereby cause a state change resolution from a steep volume change (creation of a bubble) to the ink, discharging the ink from a discharge port by an acting force based on this state change of the ink, and causing the ink to adhere to a recording medium to thereby effect image formation. In a recording apparatus using this bubble jet recording method, as disclosed in U.S. Pat. No. 4,723,129, there are generally disposed a discharge port for discharging ink therefrom, an ink flow path communicating with this discharge port, and an electro-thermal converting member as energy generating means for discharging the ink disposed in the ink flow path.

According to such a recording method, images of high dignity can be recorded at a high speed with low noise and in a head carrying out this recording method, discharge ports for discharging the ink can be disposed highly densely and therefore, there are many excellent advantages that recorded images of high resolution and further, color images can be easily obtained by a compact apparatus. Therefore, in recent years, this bubble jet recording method has come to be utilized in many office machines such as printers, copying machines and facsimile apparatuses, and further in an industrial system such as a textile printing apparatus.

As the bubble jet technique is thus utilized in products in many fields, the following various requirements have been further rising in recent years.

For example, as the examination of the requirement for improved energy efficiency, mention is made of the optimization of a heat generating member such as the adjustment of the thickness of the protective film of the heat generating member. This technique is effective in improving the propagation efficiency of generated heat to liquid.

Also, in, order to obtain images of high quality, there has been proposed a driving condition for giving a liquid discharging method in which the discharge speed of ink is high and which can accomplish good ink discharge based on the stable creation of bubbles, and from the viewpoint of high speed recording, there has been proposed an apparatus improved in the shape of a liquid flow path to obtain a liquid discharge head in which the refill speed of discharged liquid into the liquid flow path is high.

FIGS. 9A and 9B of the accompanying drawings are a top plan view and a cross-sectional view, respectively, of the essential portions of a liquid discharge head according to the prior art.

A movable member 106 supported on and fixed to an element substrate 100 by a fixing portion 106*d* is formed so that the free end 106*b* of a movable portion 106*c* may be displaced in the direction of arrow A with a root 106*a* as a fulcrum.

The upper surface side of the movable member 106 is a liquid flow path which is the flow path of ink, and arrow B indicates the direction in which the ink flows. A heat generating member 102 is formed generating energy for creating a bubble in the ink, and the bubble is created on the upper surface of the heat generating member 102. By this bubble, the free end 106*b* of the movable member 100 is displaced upwardly and the ink is discharged from a discharge port, not shown.

SUMMARY OF THE INVENTION

The present invention has as its main task to basically enhance the fundamental discharge characteristic of a conventional method of forming a bubble, particularly, a bubble resulting from film boiling, in a liquid flow path to thereby discharge liquid to a level which could heretofore not be anticipated.

We have eagerly studied to provide a novel liquid drop discharging method utilizing bubbles which could heretofore not be obtained, and a head, etc. using the method. At this time, we have carried out a first technical analysis starting from the operation of a movable member in a liquid flow path such as analyzing the principle of the mechanism of the movable member in the liquid flow path, and a second technical analysis starting from the principle of the liquid drop discharge by a bubble, and further a third analysis starting from the bubble forming area of a heat generating member for forming bubbles, and by these analyses, we have come to establish quite a novel technique for bringing the disposition relation between the fulcrum and free end of the movable member into a relation in which the free end is located at the discharge port side, i.e., the downstream side, and disposing the movable member in face-to-face relationship with the heat generating member or the bubble creating area thereof to thereby positively control the bubbles.

Next, we have come to the knowledge that when considering the energy a bubble itself gives to the amount of discharge, it is the greatest factor for being capable of markedly improving the discharge characteristic to consider the growth component at the downstream side of the bubble. That is, it has also been found that it brings about improvements in the discharge efficiency and the discharge speed to efficiently convert the growth component at the downstream side of the bubble into the discharge direction.

Further, it has been found that it is also preferable to take into account structural elements such as the movable member and the liquid flow path concerned in the growth in the heat generating area for forming a bubble, e.g., the downstream side from the center line passing through the center of the area of an electro-thermal converting member in the direction of flow of the liquid, or the downstream side of the bubble such as the center of the area on a surface which governs bubbling.

However, when durability has been confirmed on this liquid discharge head, there has been the problem that at the initial stage, the root 106*a* of the movable portion 106*c* shown in FIG. 9B is first broken away.

So, the present invention has as its object to provide a liquid discharge head for discharging liquid by the utilization of the displacement of the free end of a movable member by pressure based on the creation of a bubble, which is improved in the durability of the movable member and is stable in discharge characteristic and high in reliability, and a liquid discharge apparatus.

To achieve the above object, the liquid discharge head of the present invention is a liquid discharge head having an element substrate on the surface of which are provided in parallel a plurality of discharge energy generating elements generating heat energy for creating a bubble in liquid, a fixed portion provided on said element substrate so as to face said plurality of discharge energy generating elements, and fixed to said element substrate, and a plurality of movable members comprising a movable portion extending from the end portion of said fixed portion and displaced by said bubble, wherein a fulcrum about which said movable portion is displaced is located on said movable portion other than a corner portion formed at the boundary between said movable portion and said fixed portion.

In the liquid discharge head of the present invention constructed as described above, the fulcrum of the movable portion is formed on the other portion than the corner portions. Thereby, the concentration of stress to the corner portions is avoided.

The plurality of movable members may be of a construction in which they are connected together at the position of the fulcrum, and the movable members may be formed of silicon nitride.

The liquid discharge head of the present invention is a liquid discharge head having an element substrate on the surface of which are provided in parallel a plurality of discharge energy generating elements generating heat energy for creating a bubble in liquid, a fixed portion provided on said element substrate so as to face said plurality of discharge energy generating elements, and fixed to said element substrate, and a plurality of movable members comprising a movable portion extending from the end portion of said fixed portion and displaced by said bubble, characterized in that the shape of the fixed portion is a shape which expedites stress dispersion for preventing stress from concentrating on particular one of the movable members.

The liquid discharge apparatus of the present invention has a carriage removably holding the liquid discharge head of the present invention thereon, and supported for reciprocal movement along the surface of a recording medium, and discharges liquid from the liquid discharge head of a head cartridge to thereby effect recording on the recording medium.

DESCRIPTION OF THE PREFERRED EMBODIMENTS

Some embodiments of the present invention will hereinafter be described with reference to the drawings.

Figure 1:
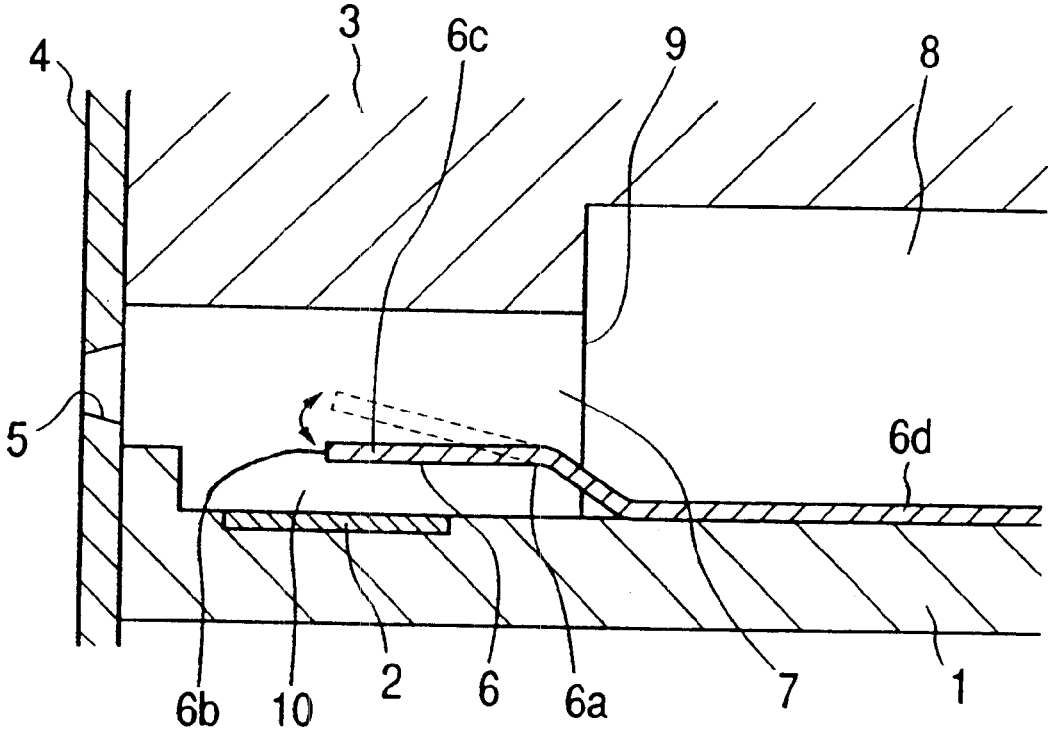
FIG. 1 is a cross-sectional view along the direction of a liquid flow path for illustrating the basic structure of a liquid discharge head according to an embodiment of the present invention.

FIG. 1 is a cross-sectional view along the direction of a liquid flow path for illustrating the basic structure of an embodiment of the liquid discharge head of the present invention.

As shown in FIG. 1, this liquid discharge head has an element substrate 1 on which are provided in parallel a plurality of heat generating members 2 (in FIG. 1, only one is shown) giving heat energy for creating a bubble in liquid, a top plate 3 joined onto the element substrate 1, and an orifice plate 4 joined to the front end surfaces of the element substrate 1 and the top plate 3.

The element substrate 1 has silicon oxide film or silicon nitride film directed to insulation and heat accumulation formed on a substrate of silicon or the like, and an electrical resistance layer and a wiring electrode constituting the heat generating members 2 and patterned thereon. A voltage is applied from the wiring electrode to the electrical resistance layer and an electric current is flowed to the electrical resistance layer, whereby the heat generating members 2 generate heat.

The top plate 3 is for constituting a plurality of liquid flow paths 7 corresponding to the heat generating members 2 and a common liquid chamber 8 for supplying liquid to the liquid flow paths 7, and flow path side walls 9 extending from a ceiling portion to among the heat generating members 2 are provided integrally therewith. The top plate 3 is formed of a silicon material, and the pattern of the liquid flow paths 7 and the common liquid chamber 9 can be formed by etching, or can be formed by etching the portions of the liquid flow paths 7 after the material of the flow path side walls 9 such as silicon nitride or silicon oxide has been accumulated on the silicon substrate by a known film forming method such as CVD.

The orifice plate 4 is formed with a plurality of discharge ports 5 corresponding to the liquid flow paths 7 and communicating with the common liquid chamber 8 through the liquid flow paths 7, respectively. The orifice plate 4 is also formed of a silicon material, and is formed by shaving the silicon substrate formed with the discharge ports 5 to a thickness of the order of 10 to 150 $\mu$m. The orifice plate 4 is not always a construction necessary to the present invention, but instead of providing the orifice plate 4, when the liquid flow paths 7 are to be formed in the top plate 3, a wall corresponding to the thickness of the orifice plate 4 is left on the fore end surface of the top plate 3, and the discharge ports 5 are formed in this portion, whereby there can be provided a top plate with discharge ports.

Further, this liquid discharge head is provided with a cantilever-like movable member 6 disposed in face-to-face relationship with the heat generating members and directly fixed to the element substrate 1. The movable member 6 is thin film formed of a silicon material such as silicon nitride or silicon oxide, or nickel or the like excellent in resiliency.

This movable member 6 is supported on and fixed to the element substrate 1 by a fixing portion 6*a* on the upstream side of a great flow flowing from the common liquid chamber 8 to the discharge ports 5 side via above the movable member 6, and is formed with a root 6*a* which provides a fulcrum when the free end 6*b* of a movable portion 6*c* is displaced. Further, so as to have the free end 6*b* at the downstream side with respect to this root 6*a*, the free end 6*b* is located at a position facing the heat generating member 2 and near the center of the heat generating member 2 and is disposed at a predetermined distance from the heat generating member 2. The space between the heat generating member 2 and the movable member 6 provides a bubble creating area 10.

When on the basis of the above-described construction, the heat generating member 2 is caused to generate heat, the heat acts on the liquid in the bubble creating area 10 between the movable member 6 and the heat generating member 2, whereby a bubble based on the film boiling phenomenon is created on the heat generating member 2 and grows. Pressure resulting from the growth of this bubble preferentially acts on the movable member 6, and the free end 6*b* of the movable member 6, as indicated by broken line in FIG. 1, is displaced so as to greatly open toward the discharge ports 5 side about the root 6*a*. By the displacement or displaced state of the movable member 6, the propagation of the pressure based on the creation of the bubble or the growth of the bubble itself is directed to the discharge ports 5 side and the liquid is discharged from the discharge ports 5.

That is, the movable member 6 having the root 6*a* at the upstream side (the common liquid chamber 8 side) of the flow of the liquid in the liquid flow paths 7 and having the free end 6*b* at the downstream side (the discharge ports 5 side) is provided on the bubble creating area 10, whereby the direction of propagation of the pressure of the bubble is directed toward the downstream side and thus, the pressure of the bubble directly and efficiently contributes to the discharge of the liquid. The direction of growth of the bubble itself, like the direction of propagation of the pressure, is directed toward the downstream side, and the bubble grows more greatly at the downstream side than at the upstream side. By the direction of growth of the bubble itself being thus controlled by the movable member to thereby control the direction of propagation of the pressure of the bubble, fundamental discharge characteristics such as discharge efficiency and discharge force or discharge speed can be improved.

On the other hand, when the bubble enters its disappearing process, the bubble rapidly disappears due to the combined effect thereof with the resilient force of the movable member 6, and the movable member 6 also finally returns to its initial position indicated by solid line in FIG. 1. At this time, in order to make up for the shrinked volume of the bubble in the bubble creating area 10 and to make up for the volume of the discharged liquid, the liquid flows in from the upstream side, i.e., the common liquid chamber 8 side and the refilling of the liquid flow paths 7 with the liquid is effected, and this refilling with the liquid is effected efficiently, reasonably and stably with the returning action of the movable member 6.

Figure 2A:
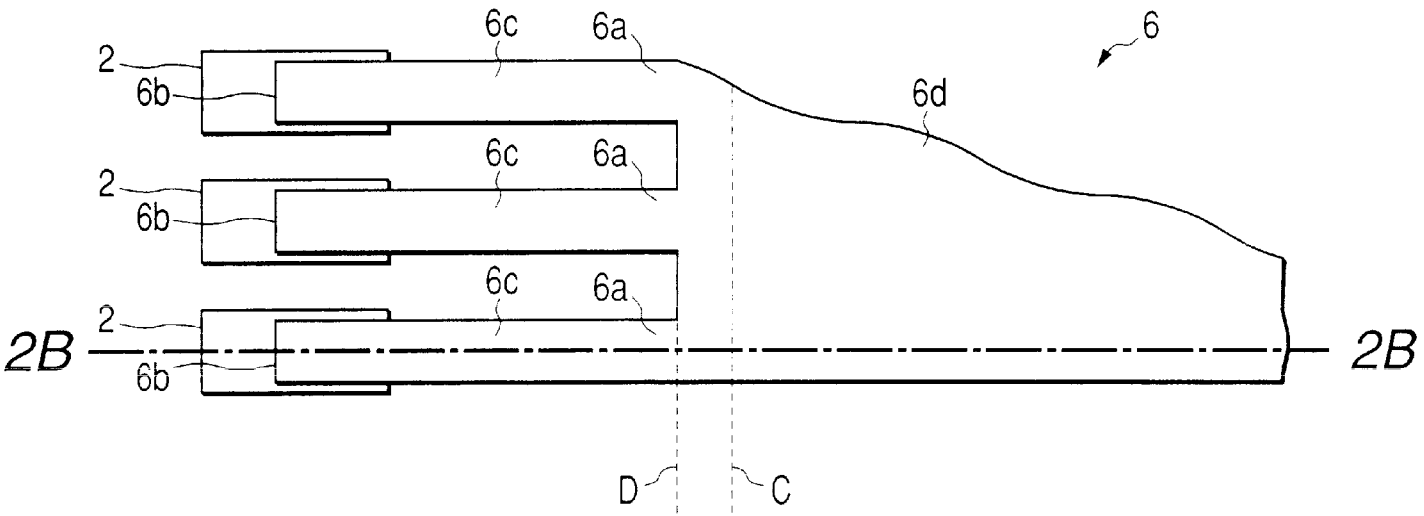
FIGS. 2A and 2B are a top plan view and a cross-sectional view, respectively, of the essential portions of the liquid discharge head of the present invention.
Figure 2B:
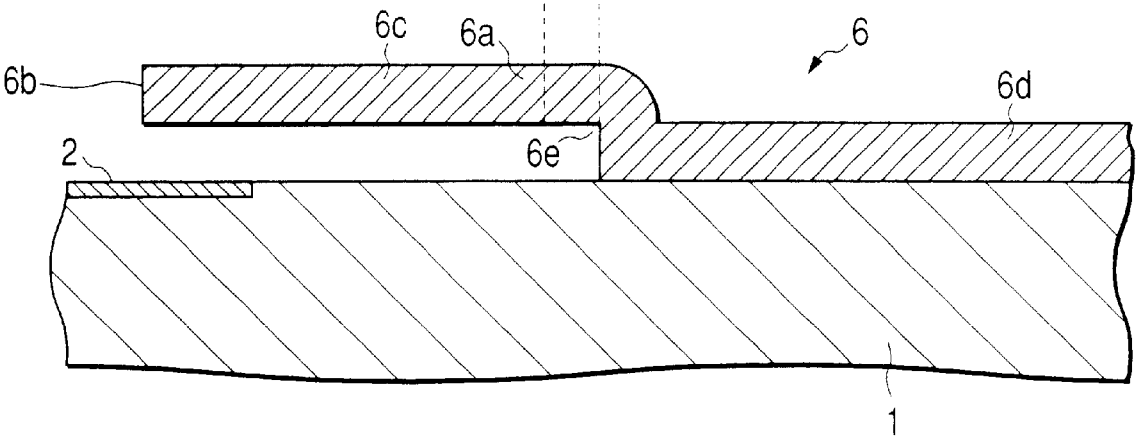

FIGS. 2A and 2B are a top plan view and a cross-sectional view, respectively, of the essential portions of the liquid discharge head shown in FIG. 1. The movable member 6 formed on the element substrate 1 is fixed by the fixed portion 6*d* via the manufacturing steps of a semiconductor device such as photolithography and etching, and the tip end portions of the movable portions facing respective ones of the heat generating members 2 provide the free ends 6*b*. Here, as shown in FIG. 2B, the roots 6*a* are formed not on a line C indicating the end portion of the fixed portion 6*d*, but on the position of a line D. Thus, the fulcrum of the movable members 6 is not the end portion of the fixed portion 6*d*, but the roots 6*a*. Accordingly, the concentration of stress to a corner portion 6*e* when the free ends 6*b* are displaced is avoided. Further, as shown in FIG. 2A, the roots 6*a* which provide the fulcrum are formed on the position of the line D, whereby the roots 6*a* are made common to adjacent movable portions 6*c*, whereby the dispersion of stress is done. Thereby, the increased strength of the movable members 6 with respect to torsion can be achieved and the durability thereof can be remarkably improved. As the result, the movable members 6 are stably displaced even during the long-term use thereof and therefore, there can be obtained a liquid discharge head which is stable in discharge characteristics and high in reliability.

Figure 3:
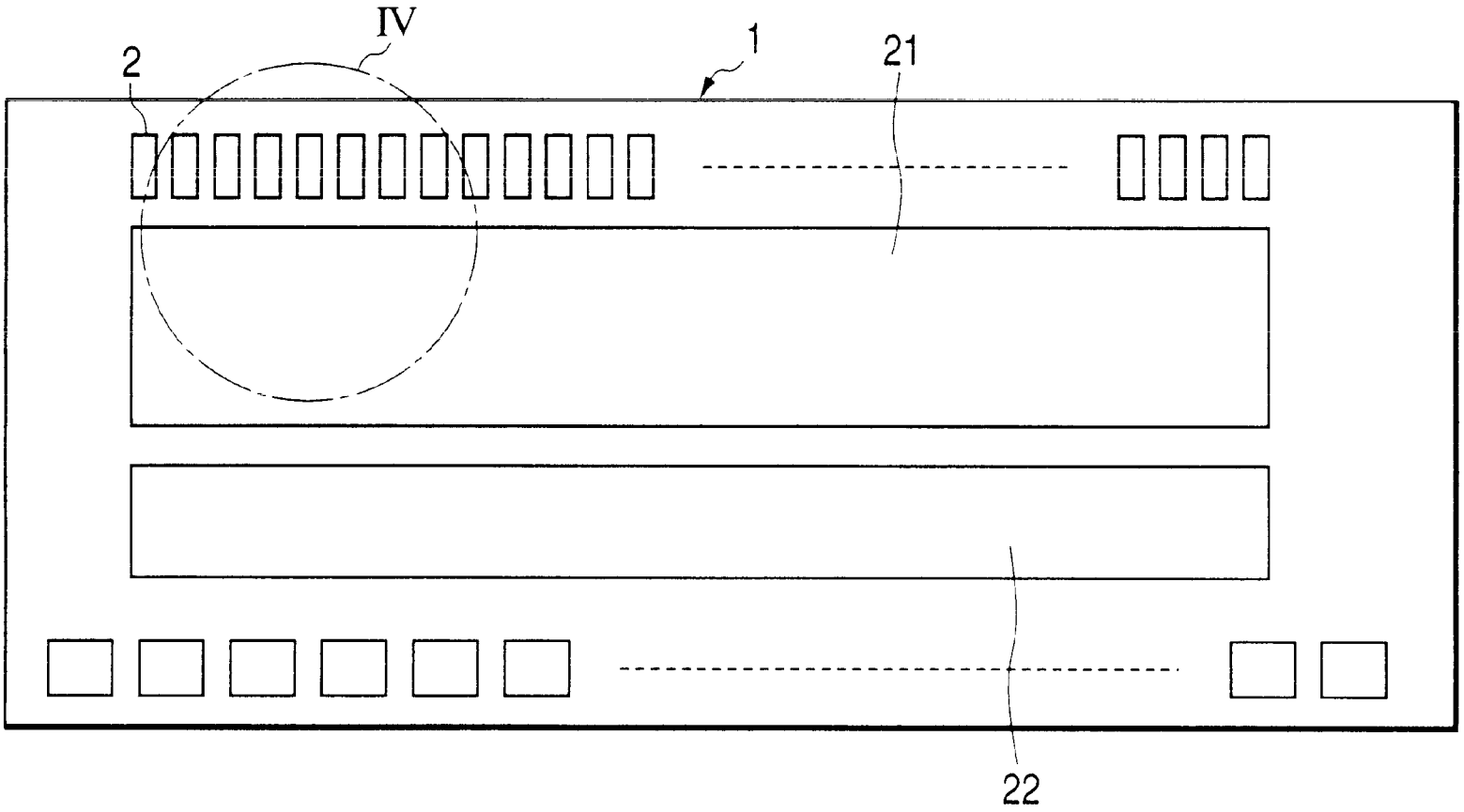
FIG. 3 is a plan view of an element substrate shown in FIG. 1.

FIG. 3 is a plan view showing the element substrate 1 shown in FIG. 1. As shown in FIG. 3, a plurality of heat generating members 2 are disposed in parallel along one edge portion of the element substrate 1 on that surface of the element substrate 1 which is adjacent to the top plate 3. The central portion of that surface of the element substrate 1 is a heater driver forming area 21, and a plurality of heater drivers arranged in the same direction as the direction of arrangement of the plurality of heat generating members 2 are formed in the heater driver forming area 21. Also, a shift register latch 22 is formed on that portion of the heater driver forming area 21 which is opposite to the heat generating members 2.

Figure 4:
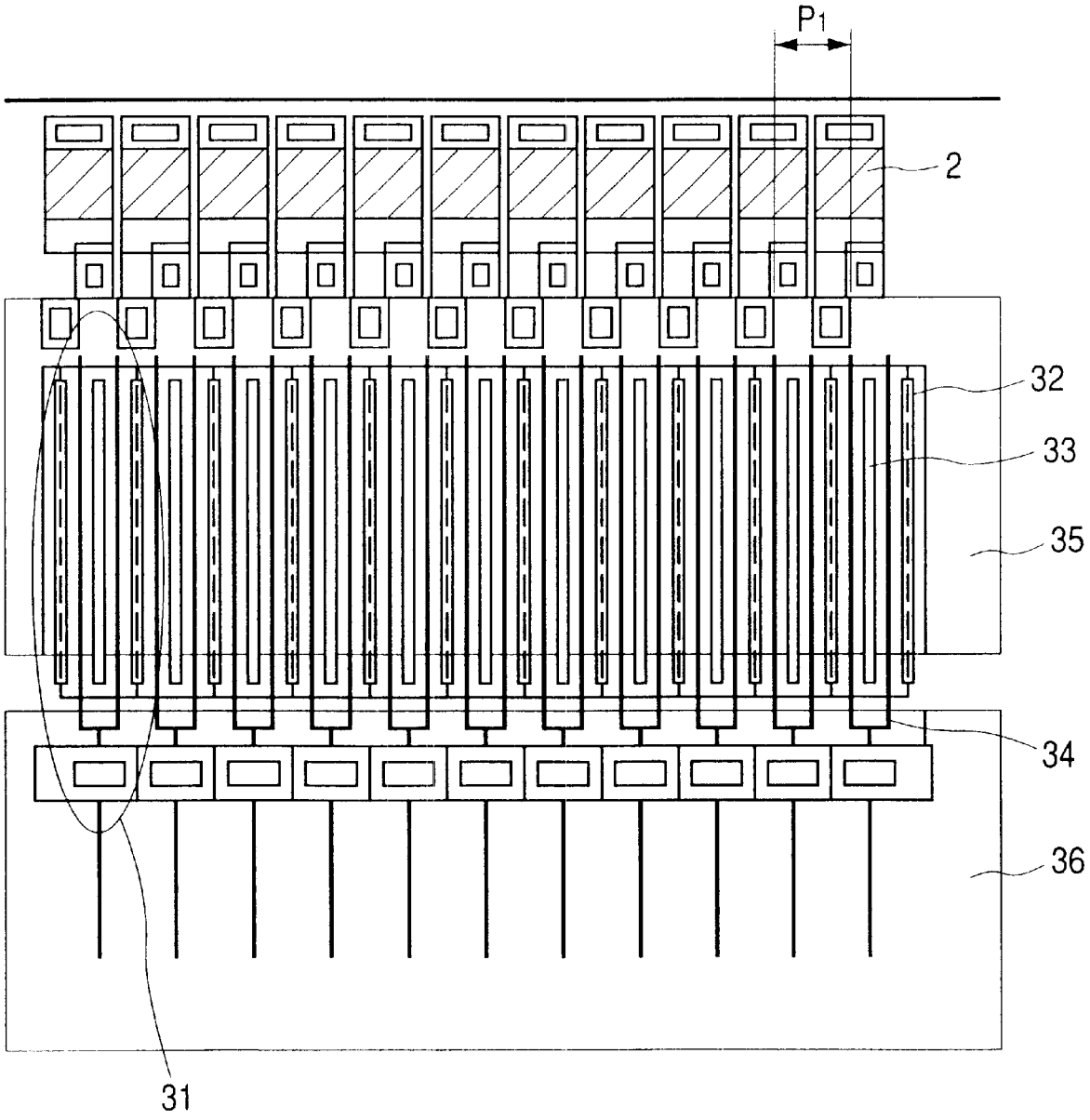
FIG. 4 is an enlarged view of the portion IV of FIG. 3.

FIG. 4 is an enlarged view of the portion IV of FIG. 3. As the element substrate 1 used in the present embodiment, use is made of one of high density heater arrangement in which the resolution of a recorded image is 600 dpi (dots per inch) or greater. With the leading about of the wiring on the element substrate 1 taken into account, a row of heater drivers for driving the heat generating members 2 form one stage. In the heater driver forming area 21 shown in FIG. 3, there are formed heater drivers 31 arranged in the same direction as the direction of arrangement of the heat generating members 2, as shown in FIG. 4. The pitch of the heater drivers 31 is the same as the pitch of the heat generating members 2, and the pitch $P_1$ thereof is 15 to 42 $\mu$m.

The heater drivers 31 are comprised of sources 32 extending in a direction perpendicular to the direction of arrangement of the heater drivers 31, drains 33 and gates 34 parallel to the sources 32. The drains 33 are electrically connected to the heat generating members 2. Also, a heater driving power source 35 constituted by a metallic layer and a gland 36 are formed in the heater driver forming area 21.

Here, the condition of the heater drivers 31 is a high withstand voltage dielectric strength (of the order of 10 to 50 V) and as previously described, drivers which can be disposed at a very narrow width of a pitch of 15 to 42 $\mu$m are necessary. As the heater drivers 31 satisfying that condition, use can be made of offset MOS type, LDMOS type or VDMOS type transistors or the like.

Figure 5:
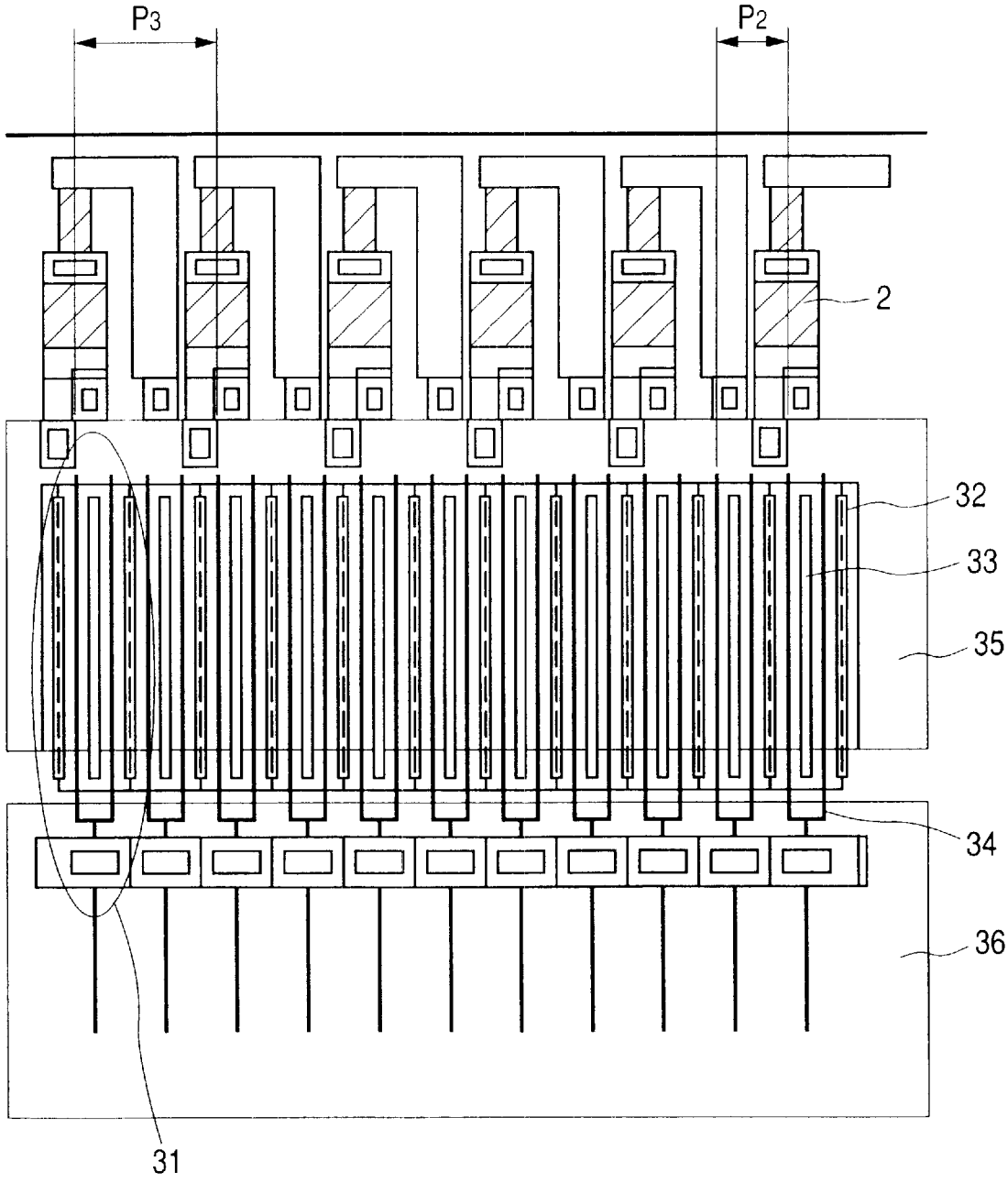
FIG. 5 is an enlarged view showing a modification of the element substrate shown in FIG. 1.

FIG. 5 is an enlarged view showing a modification of the element substrate 1 shown in FIG. 1. While in the embodiment shown in FIG. 4, the pitch of the heater drivers 31 is the same as the pitch of the heat generating members 2, in the modification shown in FIG. 5, the pitch $P_3$ of the heater drivers 31 is double the pitch $P_2$ of the heat generating members 2. By the use of such an element substrate 1, a plurality of heat generating members 2 are disposed in a nozzle and the plurality of heat generating members 2 are driven by a nozzle, whereby harmony recording ca be effected.

Description will now be made of an example in which in the element substrate 1 of the construction shown in FIGS. 4 or 5, the heat generating members 2 are arranged so that the resolution of a recorded image may be 1200 dpi. In this case, it is desirable when the irregularity of the resistance of the wiring and the power source itself and the irregularity of the heater drivers 31 are taken into account that the voltage of the power source for driving the heat generating members 2 be made as high as possible. In the present embodiment, the voltage of the power source was 24 V. The pitch of the heat generating members 2 was about 21 μm, and the width of the heat generating members 2 was 14 μm including the margin thereof. In order to secure the area of the heat generating members 2 necessary for the recording density of 1200 dpi, the length of the heat generating members 2 was 60 μm. Here, to drive the heat generating members 2 at an interval of several μs, it is necessary to make the resistance value of the heat generating members 2 great, and 50 Ω/□ or greater is required as the sheet resistance value of the heat generating members 2.

So, TaSiN was used as the material of the heat generating members 2 for 1200 dpi, whereby the resistance value of the heat generating members 2 was set to 200 Ω or greater. As the heater drivers 31, use was made of LDMOS type transistors of which the width could be made relatively small. By driving the thus constructed liquid discharge head, a recorded image of 1200 dpi could be obtained.

As described above, in the liquid discharge head wherein the heat generating members 2 are disposed highly densely, offset MOS type, LDMOS type or VDMOS type transistors are used, whereby the heater drives 31 can be disposed highly densely in a row (a stage) on the element substrate 1 and the efficient layout of the wiring becomes possible by the element substrate 1. As the result, the element substrate 1 can be downsized to a chip size. Also, by the heat generating members 2 using a material having sheet resistance as high as 50 Ω/□ or greater and the heater drivers 31 of high withstand pressure such as MOS of the above-mentioned kind capable of withstanding a voltage of 10 V or greater being combined together, there can be realized the construction of a liquid discharge head in which the irregularity of the voltage applied to the heat generating members 2 is small.

The movable member adopted in the liquid discharge head of the present invention, in its state as indicated by broken line in FIG. 1, can achieve the increased strength of the fulcrum when it is greatly flexed with the bubble created by the movable member.

Figure 6A:
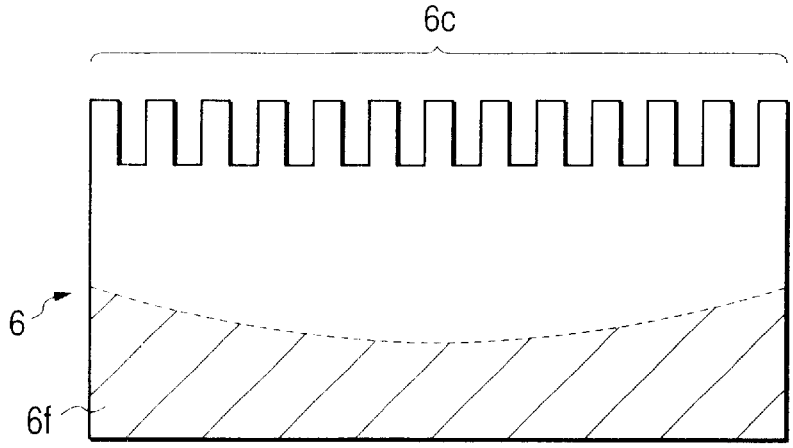
FIGS. 6A, 6B and 6C are seen-through views showing a fixed portion applicable to the present invention.
Figure 6B:
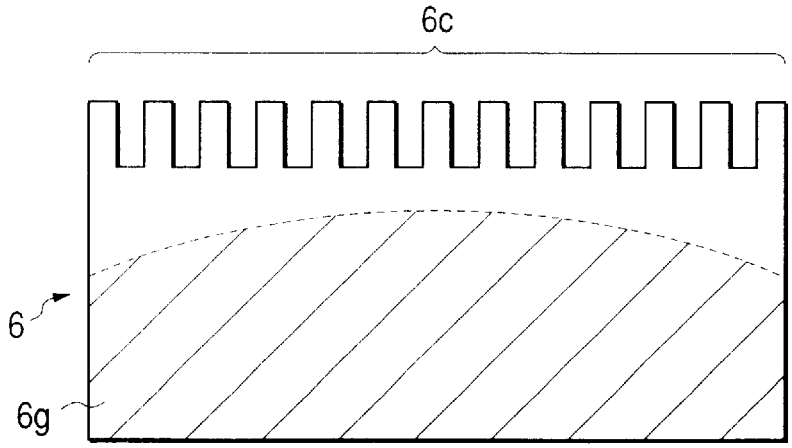
Figure 6C:
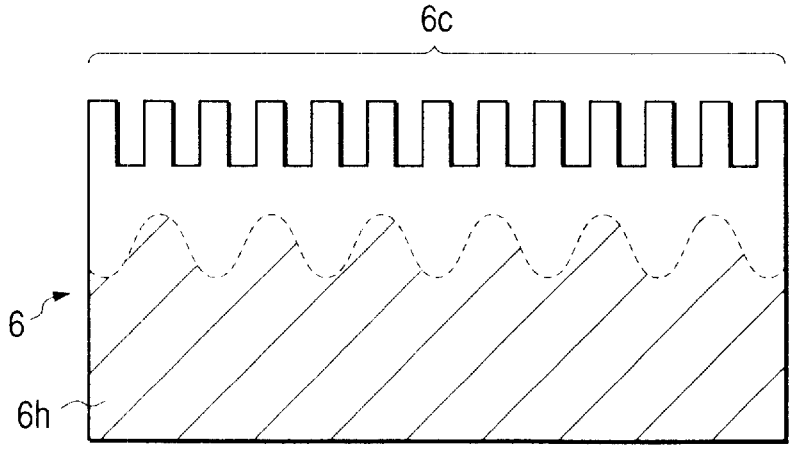

Next, FIGS. 6A to 6C show upper surface seen-through views of fixed portions 6*f* to 6*h* applicable to the present invention.

The end surface of the fixed portion 6*d* shown in FIGS. 2A and 2B which is adjacent to the corner portion 6*e* is straight, whereas said end surface may be of a concave shape as shown in FIG. 6A, or a convex shape as shown in FIG. 6B, or a wavy shape as shown in FIG. 6C. By the end surface being made into a curved shape shown in any of FIGS. 6A to 6C, the stress to the movable portion 6*c* is widely dispersed. Thereby, the stress is prevented from concentrating into the particular movable portion 6*c*.

Any other shape than the shapes shown in FIGS. 6A to 6C may be adopted if the concentration of the stress to the particular movable portion 6*c* is prevented.

Figure 7:
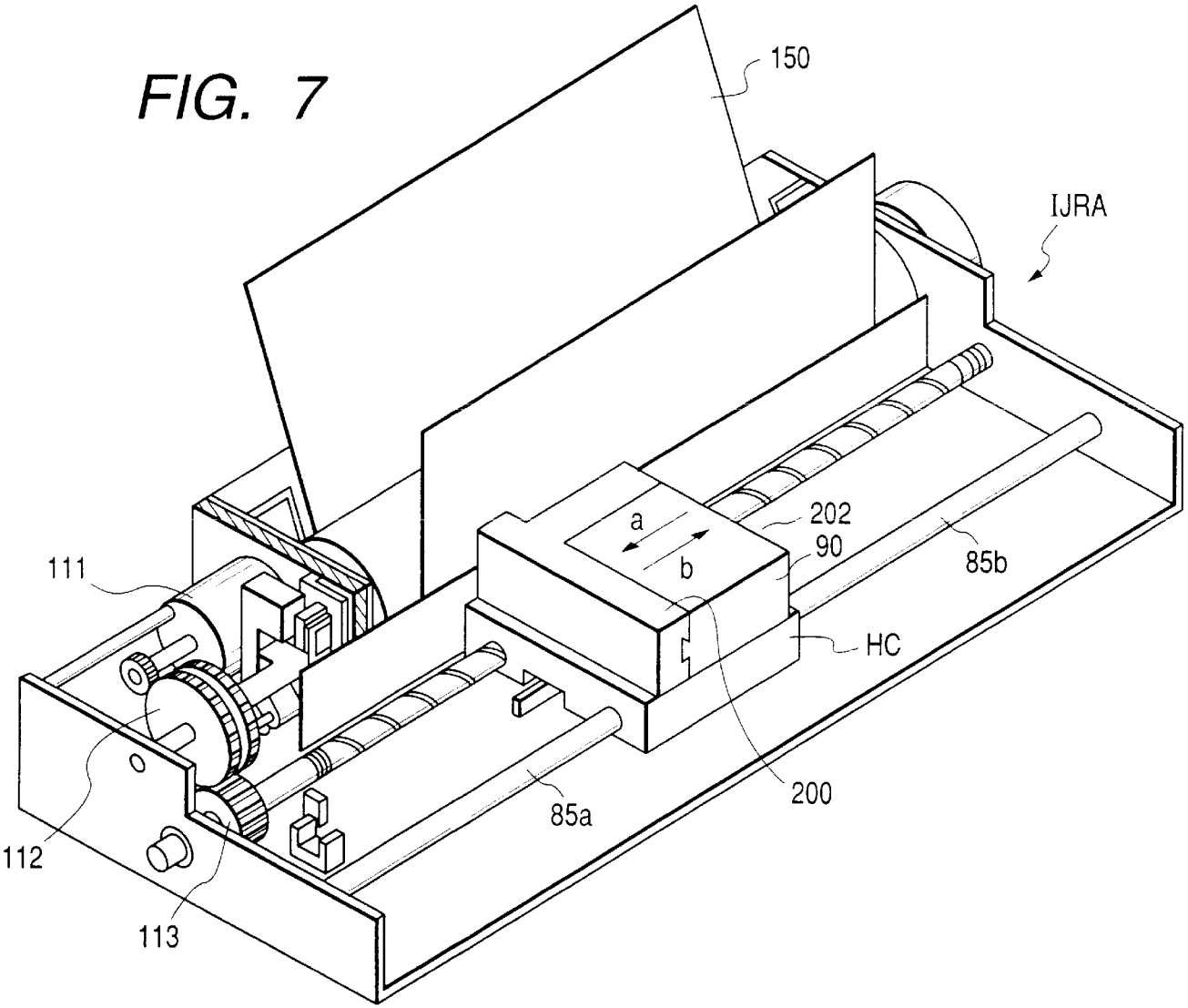
FIG. 7 is a perspective view showing a liquid discharge apparatus carrying the liquid discharge head of the present invention thereon.

FIG. 7 is a perspective view showing a liquid discharge apparatus carrying the above-described liquid discharge head thereon. The present embodiment will be described with respect to a liquid discharge apparatus IJRA using particularly ink as discharged liquid. As shown in FIG. 7, a carriage HC provided in the liquid discharge apparatus IJRA carries thereon a head cartridge 202 on which a liquid container 90 containing ink therein and a liquid discharge head 200 are detachably mountable. Also, the liquid discharge apparatus IJRA is provided with recording medium conveying means, and the carriage HC is reciprocally moved in the widthwise direction (the directions of arrows a and b) of a recording medium 150 such as recording paper conveyed by the recording medium conveying means. In the liquid discharge apparatus IJRA, when a driving signal is supplied from driving signal supplying means, not shown, to the liquid discharge head 200 on the carriage HC, recording liquid is discharged from the liquid discharge head 200 to the recording medium 150 in response to this driving signal.

Further, the liquid discharge apparatus IJRA has a motor 111 as a drive source for driving the recording medium conveying means and the carriage HC, gears 112 and 113 for transmitting the motive power from the motor 111 to the carriage HC, and carriage shafts 85*a* and 85*b*. The liquid was discharged to various kinds of recording mediums by this liquid discharge apparatus IJRA, whereby records of good images could be obtained.

Figure 8:
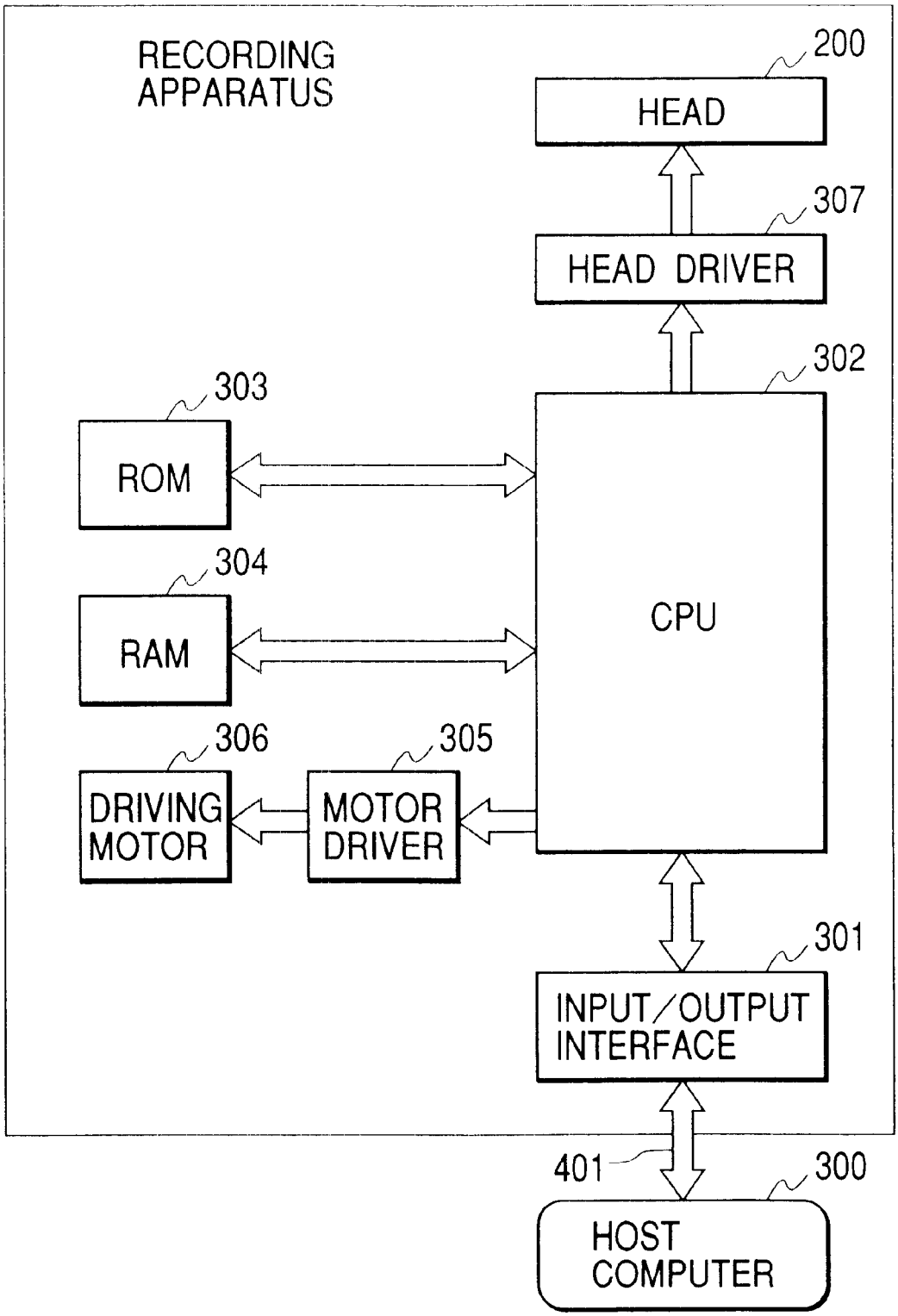
FIG. 8 is a block diagram of the whole of an apparatus for operating an ink discharge recording apparatus to which the liquid discharge head of the present invention is applied.
Figure 9A:
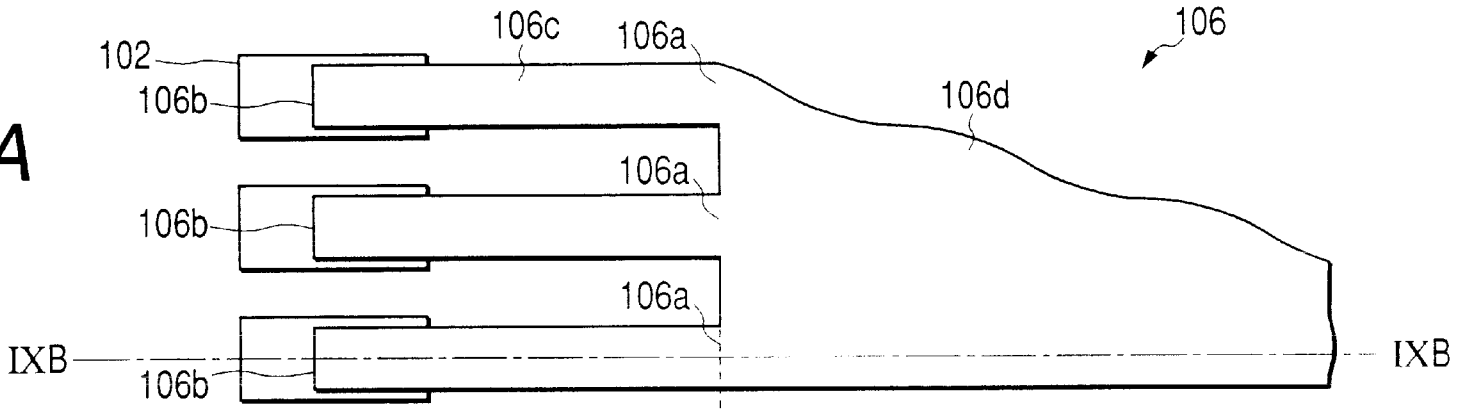
FIGS. 9A and 9B are a top plan view and a cross-sectional view, respectively, of the essential portions of a liquid discharge head according to the prior art.
Figure 9B:
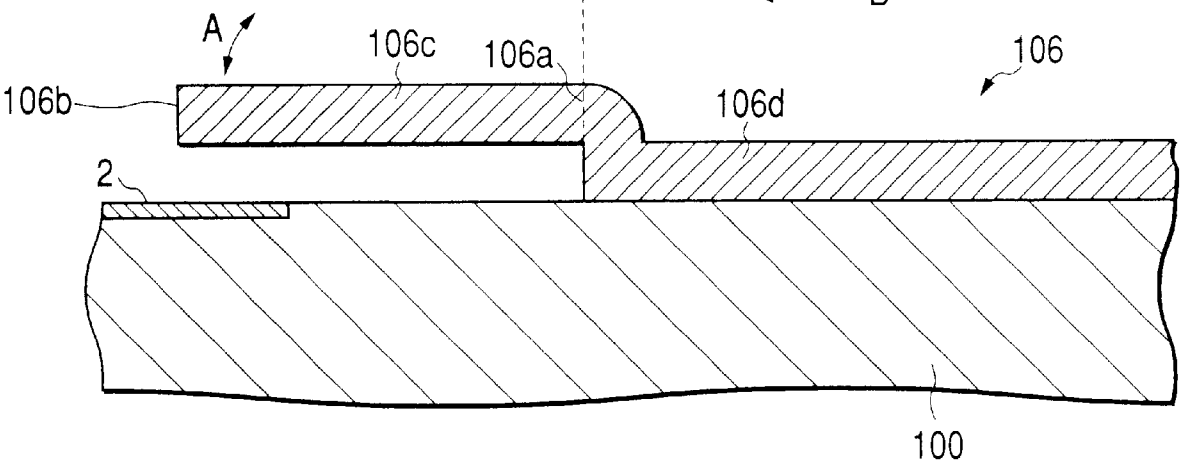

FIG. 8 is a block diagram of the whole of an apparatus for operating an ink discharge recording apparatus to which the liquid discharge head of the present invention is applied.

As shown in FIG. 8, the recording apparatus receives printing information as a control signal 401 from a host computer 300. The printing information is temporarily preserved in an input/output interface 301 in the recording apparatus and at the same time, is converted into data which can be processed in the recording apparatus, and is inputted to a CPU 302 serving also as head driving signal supplying means. The CPU 302 processes the data inputted thereto by the use of a peripheral unit such as a RAM 304 on the basis of a control program preserved in a ROM 303, and converts the data into data to be printed (image data).

Also, the CPU 302 makes driving data for driving a driving motor 306 for moving the recording paper and the liquid discharge head 200 to record the image data at a suitable position on the recording paper. The image data is transmitted to the liquid discharge head 200 through a head driver 307 and also, the motor driving data is transmitted to the driving motor 306 through a motor driver 305. Thereby, the liquid discharge head 200 and the driving motor 306 are driven at controlled timing, whereby an image is formed.

Recording mediums which can be applied to the recording apparatus as described above and to which liquid such as ink is imparted include various kinds of paper, OHP sheets, plastic materials used for compact discs, decoration plates, etc., fabrics, metal plates of aluminum, copper, etc., leather materials such as oxide, pigskin and artificial leather, woods such as lumber and plywood, bamboo material, plastic materials such as tiles, and three-dimensional structures such as sponges.

Also, the above-described recording apparatus covers a printer apparatus for effecting recording on various kinds of paper and OHP sheets, a recording apparatus for plastics for effecting recording on plastic materials such as compact discs, a recording apparatus for metals for effecting recording on metal plates, a recording apparatus for leather for effecting recording on leather, a recording apparatus for woods for effecting recording on woods, a recording apparatus for ceramics for effecting recording on ceramic materials, a recording apparatus for effecting recording on three-dimensional net-like structures such as sponges, a textile printing apparatus for effecting recording on fabrics, etc.

As the discharged liquid used in these liquid discharge apparatuses, use can be made of liquids conforming to the respective recording mediums or recording conditions.

As described above, according to the present invention, in the other movable portion than the corner portion formed at the boundary between the movable portion and fixed portion of the movable member, there is formed and fulcrum about which the movable portion is displaced and therefore, the concentration of stress to the corner portion is avoided. Also, by the shape of the fixed portion being made into a shape expediting the dispersion of stress, the concentration of stress to a particular movable member can be prevented. Thereby, the durability of the movable member can be improved and also, the discharge characteristics can be stabilized and reliability can be improved.

What is claimed is:

1. A liquid discharge head comprising:

an element substrate on the surface of which are provided a plurality of discharge energy generating elements generating heat energy for creating a bubble in liquid; and a movable member arranged by a fixed portion fixed to the element substrate and a plurality of movable portions displaced by said bubble, the movable portions extending from a corner portion of said movable member, and further extending from the corner portion in a direction parallel to said element substrate, so as to face each of said plurality of discharge energy generating elements by a predetermined distance, wherein a fulcrum about which said movable portion is displaced is located on said movable portion other than a corner portion.

2. A liquid discharge head according to claim 1, wherein said movable member is diverged to each of movable portions from a position of said fulcrum.

3. A liquid discharge apparatus having a carriage removably holding a liquid discharge head according to claim 2, and supported for reciprocal movement along the surface of a recording medium, and discharging liquid from said liquid discharge head of a head cartridge to thereby effect recording on the recording medium.

4. A liquid discharge head according to claim 1, wherein said movable members are formed of silicon nitride.

5. A liquid discharge apparatus having a carriage removably holding a liquid discharge head according to claim 4, and supported for reciprocal movement along the surface of a recording medium, and discharging liquid from said liquid discharge head of a head cartridge to thereby effect recording on the recording medium.

6. A liquid discharge apparatus having a carriage removably holding a liquid discharge head according to claim 1, and supported for reciprocal movement along the surface of a recording medium, and discharging liquid from said liquid discharge head of a head cartridge to thereby effect recording on the recording medium.

7. A liquid discharge head comprising:

an element substrate on the surface of which are provided a plurality of discharge energy generating elements generating heat energy for creating a bubble in liquid; and a movable member arranged by a fixed portion fixed to the element substrate and a plurality of movable portions displaced by said bubble, the movable portions extending from a corner portion of said movable member, and further extending from the corner portion in a direction parallel to said element substrate, so as to face each of said plurality of discharge energy generating elements by a predetermined distance, wherein a shape of an end portion at a corner portion side of said fixed portion is a shape expediting stress dispersion for preventing stress from concentrating on said fixed portion of a portion corresponding to each of said movable portions.

8. A liquid discharge apparatus having a carriage removably holding a liquid discharge head according to claim 7, and supported for reciprocal movement along the surface of a recording medium, and discharging liquid from said liquid discharge head of a head cartridge to thereby effect recording on the recording medium.

9. A liquid discharge apparatus according to claim 7, wherein a shape of an end portion at a corner portion side of said fixed portion expediting stress dispersion for preventing stress is a curved shape.

* * * * *

UNITED STATES PATENT AND TRADEMARK OFFICE

CERTIFICATE OF CORRECTION

PATENT NO. : 6,491,381 B2
DATED : December 10, 2002
INVENTOR(S) : Muga Mochizuki et al.

It is certified that error appears in the above-identified patent and that said Letters Patent is hereby corrected as shown below:

Column 1,
Line 54, “in,” should read -- in --.

Column 6,
Line 66, “ca” should read -- can --.

Column 7,
Line 31, “heater drives 31” should read -- heater drivers 31 --.

Column 8,
Line 2, “discharged” should read -- the discharge --.

Column 9,
Line 10, “and” should read -- a --.

Column 10,
Line 2, “members are” should read -- member is --; and
Line 39, “apparatus” should read -- head --.

Signed and Sealed this

Ninth Day of September, 2003

JAMES E. ROGAN
*Director of the United States Patent and Trademark Office*